US005415797A

United States Patent [19]

Ishida et al.

[11] Patent Number: 5,415,797

[45] Date of Patent: May 16, 1995

[54] DEGREASING SOLUTION AND DEGREASING METHOD

[75] Inventors: Minoru Ishida, Osaka; Shoji Shiraishi, Hyogo, both of Japan

[73] Assignee: Nippon Paint Co., Ltd., Osaka, Japan

[21] Appl. No.: 971,584

[22] Filed: Nov. 5, 1992

[30] Foreign Application Priority Data

Nov. 6, 1991 [JP] Japan ..... 3-290240

[51] Int. Cl.[6] ..... C11D 3/08; C11D 3/10; C11D 3/37; C23G 5/00

[52] U.S. Cl. ..... 252/135; 252/156; 252/173; 252/174.14; 252/174.21; 252/174.24; 134/40

[58] Field of Search ..... 252/135, 156, 173, 174.14, 252/174.21, 174.22, 174.24; 134/40

[56] References Cited

U.S. PATENT DOCUMENTS

| | | | |
|---|---|---|---|
| 3,870,560 | 3/1975 | Shumaker | 134/2 |
| 4,390,465 | 6/1983 | Spekman, Jr. | 252/527 |
| 4,844,744 | 7/1989 | Leiter et al. | 134/40 |
| 4,915,864 | 4/1990 | Kita et al. | 252/117 |

FOREIGN PATENT DOCUMENTS

| | | |
|---|---|---|
| 0282863 | 9/1988 | European Pat. Off. . |
| 0282921 | 9/1988 | European Pat. Off. . |
| 0296431 | 12/1988 | European Pat. Off. . |
| 212425 | 7/1974 | France . |
| 36-4373 | 4/1961 | Japan . |
| 54-86508 | 7/1979 | Japan . |
| 61-25784 | 6/1986 | Japan . |
| 62-199287 | 9/1987 | Japan . |
| 1-111889 | 4/1989 | Japan . |
| 1425649 | 2/1976 | United Kingdom . |

OTHER PUBLICATIONS

European Search Report for EP 92 11 8781, Apr. 20, 1993.

*Primary Examiner*—Christine Skane
*Assistant Examiner*—A. Hertzog
*Attorney, Agent, or Firm*—Townsend & Banta

[57] ABSTRACT

A method for degreasing iron, zinc or aluminum metal or an alloy comprising two or more of these metals to be processed by bringing a degreasing solution in contact with the metal to be processed, wherein said degreasing solution contains an alkali silicate, a water-soluble polycarboxylate and a nonionic surfactant and is controlled so as to satisfy the following ①, ②, ③ and ④ conditions.

① The pH value of the degreasing solution is 10.5 or more.

② The concentration of an alkali silicate is 100 ppm or more upon converting into the Si element and satisfactory for the following (a) equation:

$$\log_{10} Y \leqq 0.318\,X + 2.72 \qquad \text{(a)}$$

③ The concentration of a water-soluble polycarboxylate is in a range of from 0.01 to 10 g/liter.

④ The concentration of a nonionic surfactant is in a range of from 0.01 to 10 g/liter.

6 Claims, No Drawings

DEGREASING SOLUTION AND DEGREASING METHOD

BACKGROUND OF THE INVENTION

The present invention relates to a degreasing method for metal materials such as iron, zinc, aluminum and the like, and alloyed materials of these. In detail, the invention relates to a method for degreasing a metal surface etc. by using a degreasing solution which shows a very low foaming character and excellent degreasing capability which does not contain a phosphorous compound that may adversely affect environment.

Hitherto, in the field of metal surface processing, especially in that of metal processing industries, in advance of the conversion coating process by zinc phosphate and the like , degreasing treatment is applied for a matter to be processed to remove oil and fat (for example, a mineral oil, animal and vegetable oils etc.) attached to the matter surface.

Since the degreasing process is not a final one and is carried out prior to processing, such as a conversion coating process, an ingredient in the degreasing solution such as remaining by itself or as its reaction product on the surface of a matter to be processed may adversely affecting the conversion coating process.

In general, a degreasing solution has been adopted such as containing a builder having an acid or alkali as a main body and also, containing a nonionic or an anionic type surfactant as a main ingredient.

The phosphates such as an alkali metal phosphate or alkali metal condensed phosphate or the like have been used as an useful builder to assist the degreasing capability. Recently, it has been pointed out that the phosphates cause eutrophication and pollution in lakes and marshes. Accordingly, in the degreasing of metal surfaces, there has been desired the development of a degreasing solution, free of any phosphates.

On the other hand, increasingly there are instances where a matter is to be processed, like an automobile body, consisting of two kinds or more of metal materials such as a composite structure material, which contains not only an iron material and a zinc alloy material, but also an aluminum alloy material. Where a matter to be degreased consists of two or more kinds of metal materials, the formulation of the degreasing solution and processing conditions must be chosen so as to be processed excellently in a conversion coating process.

An example of a degreasing solution without any combined phosphate is disclosed in Japanese Examined Patent Publication, showa 61-25784. This degreasing solution is an alkaline degreasing composition consisting of a nonionic surfactant, builder, hydrosulfite and succharide. If a calcium or magnesium salt is added to this degreasing solution, deterioration of the degreasing capability occurs. Also, if the aforementioned composite structure material is degreased by this degreasing solution, it is not processed excellently in conversion coating process.

A method of degreasing with which the aforementioned composite structure material can have an excellent conversion coating performance has been proposed in Japanese Official Patent Provisional Publication, showa 62-199787. In this method, when a matter to be processed is processed by an alkali silicate-based degreasing agent, a degreasing solution is controlled so as to have its pH at 10.5 or more and to keep the combined Si concentration satisfactorily for the following equation (a). However, the degreasing solution used in this method has a phosphate as an alkali builder. When this degreasing solution does not contain the phosphate, it does not display sufficient degreasing capability.

Meanwhile, in a case where a spraying method is adopted in a processing facilities for decreasing metal surfaces, the degreasing solution must be of an especially low foaming character. Conventional degreasing solutions comprise low foaming surfactants such as disclosed in Japanese Examined Patent Publication, showa 36-4373 and Japanese Official Patent provisional Publication, showa 54-86508. In Japanese Examined Patent Publication, showa 36-4373, surfactants denoted by the following general formula (1) and in Japanese Official Patent Provisional Publication, showa 54-86508, surfactants denoted by the following general formula (2) are, respectively, used.

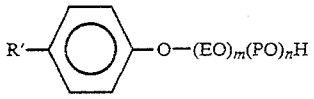

(1)

in the formula, R', EO, and PO denote an alkyl group, ethylene oxide group, and a propylene oxide group, respectively, and m and n show an added mole number.

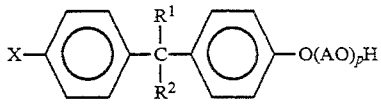

(2)

in the formula, X denotes a hydrogen atom or a hydroxyl group, $R^1$ and $R^2$ denote a hydrogen atom or a methyl group, AO denotes an alkylene oxide group, and p shows an added mole number.

SUMMARY OF THE INVENTION

Not only the single use of surfactants represented by the formulae of (1) and (2), but also their combined use with various kinds of builders other than phosphates cannot continuously display the excellent degreasing capability. Alkylates of nonylphenol, that are representative examples of the above formula (1), have been pointed out to show fish-toxicity in their decomposition products and the toxicity is stronger than that of the compounds before decomposition, so that their use in detergents for household use is regulated. In the field of detergents for industrial use, their use is being regulated. Therefore, there has been desired the combination of a surfactant, which shows excellent degreasing capability by being combined with various kinds of builders showing a low foaming character and not containing a phosphate, which will not adversely effect the environment.

It is an object of the present invention to provide a degreasing method, which does not use that may adversely affect the environment, and which shows a low foaming character and excellent degreasing capability as well as assist good conversion coating performance, when it is applied to a structure consisting of one or more metal materials such as iron, zinc, aluminum, and alloys containing two or more of these metals.

To solve the above object, the present invention provides:

First, a degreasing solution used of a method for degreasing a matter to be processed by bringing a degreasing solution in contact with said matter to be processed, characterized in that said degreasing solution contains an alkali silicate, a water-soluble polycarboxylate and a nonionic surfactant and satisfies the following ①, ②, ③ and ④ conditions.

① The pH value of the degreasing solution is 10.5 or more.

② The concentration of an alkali silicate is 100 ppm or more upon conversion into the Si element and satisfying the following (a) equation.

$$\log_{10}Y \leqq 0.318X + 2.72 \quad \text{(a)}$$

in the equation, Y denotes the concentration of an alkali silicate (upon converting into Si and by a ppm unit), $X = pH - 10.5$, and this pH denotes the pH value of the degreasing solution.

③ The concentration of a water-soluble polycarboxylate is in a range of from 0.01 to 10 g/liter.

④ The concentration of a nonionic surfactant is in a range of from 0.01 to 10 g/liter;

Second, a method for degreasing a matter to be processed by bringing the aforementioned degreasing solution in contact with said matter to be processed;

Third, a method comprising a step of controlling the aforementioned degreasing solution by adding at least one of an agent A and an agent B to said degreasing solution, said agent A contains 1 to 6% by weight of an alkali silicate (upon converting into Si against the total alkali compounds), 20 to 60% by weight of an alkali carbonate against the total alkali compounds), and 10 to 50% by weight of a caustic alkali (against the total alkali compounds) against the total 100% by weight of the three ingredients, and said agent B contains 5 to 40% by weight of a water-soluble polycarboxlate, 10 to 60% by weight of a nonionic surfactant, and 0 to 85% by weight of water against the total 100% by weight of the three ingredients.

The degreasing solution used in this invention contains an alkali silicate, a water-soluble polycarboxylate and nonionic surfactant and, even though it is free of phosphate, it shows a low foaming character and excellent degreasing capability.

The pH value of the degreasing solution of this invention is required to be 10.5 or more and its preferred range is 10.5 or more to 12.5) or less ($10.5 \leqq pH \leqq 12.5$.

If the value is less than 10.5, there occurs the undermentioned problem and, if it exceeds 12.5, an aluminum material is excessively etched and the conversion coating process may be adversely affected.

In order to maintain the pH value of a degreasing solution at 10.5 or more, a ingredient to adjust the pH is added to the degreasing solution in addition to the aforementioned essential ingredients. Preferable ingredients of this type are, for example, alkali carbonates such as sodium hydrogen carbonate, sodium carbonate, potassium hydrogen carbonate, potassium carbonate and the like; caustic alkali such as sodium hydroxide, potassium hydroxide and the like; and these compounds are used alone or in combination of two kinds or more.

Preferable alkali silicates used in this invention are, for example, alkali metal salts of orthosilicic acid such as sodium orthosilicate, potassium orthosilicate and the like; alkali metal salts of metasilicic acid such as sodium metasilicate, potassium metasilicate and the like; alkali metal salts of sesquisilicic acid such as sodium sesquisilicate, potassium sesquisilicate and the like; and these compounds are used alone or in combination of two kinds or more.

The concentration of an alkali metal salt of silicic acid used in this invention is required to be 100 ppm or more upon converting into the Si element. If the concentration of an alkali metal salt of silicic acid is less than 100 ppm upon converting into Si, there is a problem mentioned below. However, there is a problem, if the concentration is too high, and it is required to maintain the relationship between the concentration and the pH value of a degreasing solution so as to be satisfactory for the above-described equation (a).

The water-soluble polycarboxylate used in this invention is not especially limited, as far as it is soluble in water of 0° C. or a higher temperature in an amount of 0.01 g per liter or more. A preferred polycarboxylate of this type has the weight-average molecular weight in a range of from 5,000 to 100,000, and a more preferred one has a range of from 10,000 to 100,000. The water-soluble polycarboxylate used in this invention is a mono polymer or a copolymer of unsaturated carboxylic acids having one polymerizable double bond, and preferable polycarboxylate is a salt, carboxylic groups of which are neutralized by an alkali metal such as sodium, potassium and the like. If the weight average molecular weight of a polycarboxylate is less than 5,000 or exceeds 100,000, the degreasing capability does not sufficiently rise and may deteriorate with the passage of time. It is required to maintain the concentration of a water-soluble polycarboxylate in a degreasing solution in a range of from 0.01 to 10 g per liter. If the concentration of a water-soluble polycarboxylate is less than 0.01 g per liter, the degreasing capability does not sufficiently rise and may deteriorate with the passage of time. If the concentration exceeds 10 g per liter, a substantial amount of the degreasing solution is consumed, in that the viscous solution attaches to a matter to be processed and, in addition, and therefor there is an economical disadvantage with no increase in degreasing effectiveness. The water-soluble polycarboxylate is commercially available and, for example, the following goods can be obtained and used for this invention.

Products of BASF Co., Ltd.

"Sokalan (registered trademark) CP-5" (a resin solution containing 40% by weight of a sodium salt of a maleic acid-acrylic acid copolymer having ? 0,000 in weight average molecular weight)

"Sokalan (registered trademark) CP-7" (a resin solution containing 40% by weight of a sodium salt of a maleic acid-acrylic acid copolymer having 50,000 in weight average molecular weight)

"Sokalan (registered trademark) PA-40" (a resin solution containing 40% by weight of sodium polyacrylate having 15,000 in weight average molecular weight)

Products of Kao Co., Ltd.

"Poiz (registered trademark) 520" (a resin solution containing 40% by weight of a specific polycarboxylate)

"Poiz (registered trademark) 521" (a resin solution containing 40% by weight of a specific polycarboxlate)

"Poiz (registered trademark) 531" (a resin solution containing 40% by weight of a specific polycarboxylate)

Products of Asahi Denka Kogyo Co., Ltd.

"Adekacol W-193" (a resin solution containing 25% by weight of a sodium salt of a diisobutylene-olefin-maleic anhydride copolymer)

"Adekacol W-304" (a resin solution containing 40% by weight of sodium polyacrylate)

"Adekacol W-370" (a resin solution containing 40% by weight of a sodium salt of a maleic acid-acrylic acid copolymer)

Examples of the nonionic surfactant used in this invention is such as hitherto-known in public. Among various nonionic surfactants, a preferred surfactant is a monoalkyl ether of polyethylene oxide from a viewpoint that it is superior in degreasing capability and low in fish-toxicity, and another preferred one is a monoalkyl ether of polyethylene oxide polypropylene oxide from a viewpoint that it is superior in degreasing capability, low in fish-toxicity, and superior in a defoaming character (low foaming character). Among these monoalkyl ethers, preferred is a nonionic surfactant which is an adduct of an aliphatic alcohol with an alkylene oxide, and in which 50 mole % or more of the alkylene oxide is ethylene oxide, less than 50 mole % is either one or both of propylene oxide and butylene oxide, and the cloud point is in a range of from 25° to 50° C. If the cloud point of the nonionic surfactant is less than 25° C., the degreasing capability is not enough and, if it exceeds 50° C., the foaming character rises, so that there occurs a problem of use in spray facilities. An adduct of an aliphatic alcohol with an alkylene oxide such as mentioned above is, for example, a compound shown by the following general formula (b).

$$R—O—(EO)_k(PO)_lH \quad (b)$$

in the formula, R denotes an alkyl group of from 8 to 18 in carbon atoms, EO denotes an ethylene oxide group, PO denotes either one or both of a propylene oxide group and butylene oxide group, k is an added mole number in a range of from 8 to 15, and 1 is an added mole number in a range of from 1 to 5.

In the above (b) formula, R denotes an alkyl group of from 8 to 18 in carbon number and it may be a straight chain or a branched type. If the carbon number of R is less than 8 or exceeds 18, the degreasing capability may deteriorate. If the added mole number of ethylene oxide is less than 8, the degreasing capability may deteriorate, and if it exceeds 15, the defoaming character may become bad. If the added mole number of either one or both of the propylene oxide group and butylene oxide group is 0, the defoaming character becomes bad, so that it may take much time to rinse the degreasing solution by water. If the added number exceeds 5, the degreasing capability may decrease. Furthermore, the total of added mole number of moles of the ethylene oxide group and either one or both of the propylene oxide group and butylene oxide group is preferably in a range of from 9 to 20.

Nonionic surfactants which are adducts of aliphatic alcohols with alkylene oxides as described above are commercially available and, for example, the goods described hereinafter can be obtained and used in this invention.

Products of BASF Co., Ltd.

"Plurafac (registered trademark) LF-220" (cloud point 41° C.)

"Plurafac (registered trademark) LF-400" (cloud point 32° C.)

In the degreasing solution used in this invention, one or two or more kinds of a nitrite, titanium phosphate, an antiseptic may be properly combined in addition to the aforementioned essential ingredients. Although the content of these optional can ingredients differs depending upon the ingredients, preferably the content is in a range of from 0.01 to 1 g per liter. If this content is lower than the range, the additive effect may not emerge, and if it is over this range, the object of this invention may not be attained.

To maintain its ingredients and concentration, the degreasing solution used in this invention is supplemented with an alkali silicate, a caustic alkali carbonate, water-soluble polycarboxylate and nonionic surfactant. When a supplementary ingredient is added to maintain the free alkali extent in a range of from 5 to 25 point, formulation of the undermentioned agent A is adjusted so as to put the Si concentration and pH of the degreasing solution in a range defined in this invention and thus, the proportion of the agent B to be supplied to the agent A is also determined. The Si concentration can be grasped by atomic absorption spectrometry, the water-soluble polycarboxylate is quantitatively determined by liquid chromatography etc. and the nonionic surfactant by phosphorus molybdic acid method. One example of the supplementary ingredient is as follows. Agent A: 1 to 6% by weight of an alkali silicate (upon converting into Si against the total alkali compounds)

20 to 60% by weight of an alkali carbonate against the total alkali compounds 10 to 50% by weight of a caustic alkali against the total alkali compounds agent B: 5 to 40% by weight of a water-soluble polycarboxylate 10 to 60% by weight of a nonionic surfactant 0 to 85% by weight of water (% by weight of A and agent B is a numeral value against the total 100% by weight of the three ingredients)

The supplementation of agent A is carried out so as to maintain the free alkali extent of a degreasing solution in a range of from 5 to 25 point. If the free alkali extent of a degreasing solution is less than 5 point, the pH of the degreasing solution becomes a value of less than 10.5, so that deterioration of the degreasing capability with the passage of time as well as deterioration of a converting character and coating character of a matter to be processed may be brought about. If the free alkali extent of a degreasing solution exceeds 25 point, the effects obtained in the range of from 5 to 25 point which is defined by this invention can not be obtained and the consuming amount of ingredients in the degreasing solution will increase without effects. Here, the free alkali extent is expressed by an amount (ml) of a 0.1N hydrochloric acid (or sulfuric acid) required in neutralizing 10 ml of the degreasing solution using phenolphthalein as an indicator. The content % of a caustic alkali which has in the total alkali ingredients of the agent A is adjusted in a range of from 10 to 50% by weight. If the content of a caustic alkali is less than 10% by weight, even if the agent A is supplemented to maintain the free alkali extent of the degreasing solution in a range of from 5 to 25 point, it becomes difficult to maintain the equibrium pH of the degreasing solution at 10.5 or more, or to maintain the composition of the degreasing solution within the above-described (a) equation. Therefore, deterioration of the degreasing capability with the passage of time as well as deterioration of a converting and a coating character of a matter to be processed may occur. Also, if the content of a caustic alkali exceeds 50% by weight, and when the agent A is supplemented to maintain the free alkali extent of the degreasing solution in the aforementioned range, the concentration of a silicate in the degreasing solution decreases with the passage of time and the degreasing capability may decrease compared with the initial stage. The concentration of an alkali silicate in the total alkali ingredients of the agent A is adjusted in a range of from 1 to 6% by weight upon converting into the Si element. If the concentration of an silicate exceeds 6% by weight, it becomes difficult to maintain the degreasing solution composition satisfactory for the above-described (a) equation, and thereby, deterioration of convertion coating and paint performance of a matter to be processed may occur. Also, if the silicate concentration is less than 1% by weight, even if the agent A is added to maintain the free alkali extent of the degreasing solution at a range of from 5 to 25 point, the concentration of a silicate in the decreasing solution decreases with the passage of time and the degreasing capability may deteriorate with the passage of time.

The ingredients in the agent A may be added to the degreasing solution individually but their supplementing proportions are desirable in the aforementioned proportions.

Also, to maintain the concentrations of a water-soluble polycarboxylate and a nonionic surfactant in the degreasing solution, the agent B is added. The respective content percents of ingredients in the agent B may be properly chosen corresponding with the respective controlled concentrations in the degreasing solution. Addition of the agent B may be carried out by analyzing the concentrations of respective ingredients in the degreasing solution and according to the reducing amounts of ingredients, but for the sake of convenience, it is carried out with a constant amount ratio against the aforementioned addition of the agent A.

The degreasing method of this invention may be carried out similarly to a common degreasing method. For example, there is adopted a processing condition comprising a temperature in a range of from 20° to 60° C. and a time in a range of from 1 to 30 minute. If the temperature is lower than 20° C., or if the time is less than 1 minute, degreasing capability may become insufficient, and if the temperature exceeds 60° C., or if the time is longer than 30 minutes, the conversion coating performance of a zinc material may decrease.

Preferred methods to bring the degreasing solution in contact with a matter to be processed are, for example, an immersing method, a spraying method, and a solution-contact method which consists of a combination of here-mentioned methods.

On a metal surface degreased by a degreasing solution containing an alkali silicate , a water-soluble polycarboxylate and nonionic surfactant, pH of which is 10.5 or more and in which the Si content and pH value are maintained in a range satisfactory for the above-described (a) equation relationship, an excellent quality crystalline film of zinc phosphate (the 151 type crystal face is many by a X-ray diffraction method) is formed by subsequent conversion coating process. On the other hand, on a metal surface degreased under a condition deviating from the range of the above-described (a) equation, even if its pH is less than 10.5 or it is 10.5 or more, a zinc phosphate film having a lot of 020 type crystal faces of inferior quality is formed by conversion coating process. Further, if the degreasing is continued at a pH of less than 10.5, especially in a case of being processed in a low temperature range of from room temperature to 50° C. or less as carried out in the present invention, the contained surfactant has a decomposing trend and the degreasing capability deteriorates with the passage of time.

An excellent degreasing character is obtained by maintaining the concentration of a water-soluble polycarboxylate in a range of from 0.01 to 10 g per liter and the concentration of a nonionic surfactant in a range of from 0.01 to 10 g per liter.

A calcium salt or a magnesium salt or the like mingled into a degreasing solution decreases the degreasing capability by combining with a silicate. Therefore, a builder is added as a dispersing agent. However, in a case where a phosphate is not used, decrease of the degreasing capability still occurs. In the present invention, since a water-soluble polycarboxylate is added to the degreasing solution to maintain its concentration in the aforementioned range, even if a calcium salt or a magnesium salt mingles with the degreasing solution, the decrease of degreasing capability does not occur.

According to the present invention, by using a degreasing solution not containing a phosphorus compound which may adversely environment, a structure material consisting of one kind or more of metal materials among alloys containing iron, zinc, aluminum, or two kinds or more of these metals can be processed with degreasing, which shows a low foaming character and an excellent degreasing character, and thereby, the processed structure as an excellent conversion coating performance.

DESCRIPTION OF THE PREFERRED EMBODIMENTS

The present invention is illustrated by the following Examples of some preferred embodiments in comparison with Comparative Examples not according to the invention. However, the invention is not limited to the following Examples.

EXAMPLE 1

A degreasing solution was prepared as shown in the column denoted as "initial" in Table 1. The aforementioned "Sokalan (registered trademark) CP-5" (a solid portion, 40%) is used for a water-soluble polycarboxylate and the "Plurafac (registered trademark) LF-220" for a nonionic surfactant.

In a process comprising continuous degreasing treatment, the agent A, that is a supplementary ingredient and made by formulation shown in Table 2, was supplied so as to maintain a free alkali extent of the degreasing solution at 15 point and, with supplying the agent B at a proportion of about 30 parts by weight against 100 parts by weight of the agent A, a cold rolled carbon steel sheet, zinc-nickel complex plated steel sheet and an aluminum-magnesium alloy aluminum sheet were degreased.

Degreasing and rinsing process

Degreasing: immersing method, at 40° for 2 minutes

Rinsing: spraying method, at 15°~40° C. for 15 seconds

As a result of the continuous treatment, three kinds of test slips degreased and rinsed until reaching an equilibrium condition showed an excellent degreasing character and foaming trouble in the degreasing bath and rinsing bath was not observed and, as shown in the column denoted as "in passage of time" in Table 1, great change was not recognized in the solution characteristics.

The degreasing capability as well as the foaming character were investigated as described below, and the obtained results are also shown in Table 1.

The degreasing capability was examined in a manner which comprises judging by the wetting character (a water-wetting area percentage) of the surfaces of three sorts of plates processed by rinsing after the degreasing process, and evaluated by the following standards.

◎:100% of water-wetting

○:90% or more of water-wetting

X:less than 90% of water-wetting

The foaming character was examined in a manner which comprises judging by a foaming condition in a rinsing bath in rinsing after the degreasing process, and evaluating by the following standards.

◎:Almost no foam was observed on a solution surface of the rinsing bath.

○:Although a foaming condition was observed on a solution surface of the rinsing bath, there was no case where foam overflowed from the bath having a water temperature of 20° C. or higher.

X :When a solution temperature in the rinsing bath was 20° C. or lower, the foaming character was strong and a condition of overflowing foam was observed.

Each of the test slips degreased and rinsed was processed with a 0.1% weight/volume solution of Surffine (registered trademark) N-5 (a surface-conditioner, made by Nippon Paint Co., Ltd.) at room temperature for 15 seconds and then processed by immersing it in a processing solution of Surfdine (registered trademark) SD 2500 (a Ni-Mn modified zinc phosphate processing agent, made by Nippon Paint Co., Ltd.) at 40° C. for 2 minutes.

Surface-conditioning process

Surface-conditioning: immersing method at room temperature for 15 seconds

Conversion coating process

Conversion: immersing method, at 40° C. for 2 minutes

Rinsing: spraying method, at room temperature for 15 seconds

Rinsing by deionized water: spraying method, at room temperature for 15 seconds

Drying: at 100° C. for 5 minutes

On all the conversion coating-processed plates were formed excellent quality crystalline films. Further, on these conversion coating-processed plates, a cationic electrodeposition coating Power Top (registered trademark) U-1000 (made by Nippon Paint Co., Ltd.) was coated by electrodeposition and baked at 170° C. for 20 minutes. Thickness of the obtained dried films was 35 μm hereinafter, the same). Next, on the plates coated by electrodeposition, an intermediate coating ("Orga registered trademark) TO4811 grey", a melamine alkyd resin type, made by Nippon Paint Co., Ltd.) was coated by spraying so as to make a baked, dried film of 30 μm thickness and then, baked at 140° C. for 20 minutes. Next, a top coat ("Orga (registered trademark) TO 630 dover white", a melamine alkyd resin type, made by Nippon Paint Co., Ltd.) was coated by spraying so as to make a baked, dried film of 30 μm thickness and then, baked at 140° C. for 20 minutes, whereby coated plates with three coats and three bake in total were obtained. These coated plates were subjected to an adhesion test.

The adhesion test was carried out by immersing the coated plate in deionized water of 40° C. for 20 days, making checkerboard squares of 1 mm and 2 mm intervals (100 pieces) on the plate by a keen cutter, pasting a tackiness tape on the plate face, peeling off the tape, and counting the number of checkerboard squares remaining on the plate.

Adhesion of three kinds of test slips was all excellent.

The coating quality was examined by the above-described adhesion test and evaluated by the following standards.

◎:100/100 squares remained without falling in the test by checkerboard squares of 1 mm interval.

○:Although falling on a part of the film was recognized in the test by checkerboard squares of 1 mm interval, 100/100 squares rémained without falling in that of 2 mm interval.

X: Falling on a part of the film was recognized in the test by checkerboard squares of 2 mm interval.

Results are shown in Table 1.

EXAMPLES 2 TO 4 AND COMPARATIVE EXAMPLES 1 AND 2

The degreasing and rinsing procedure of example 1 was repeated except that control of the degreasing solution was changed as shown in Table 1 and the supplementary ingredients shown in Table 2 were used. Then, similar to the example 1, the conversion coating process and coating were carried out to get coated plates. Similar to the example 1, the degreasing capability, foaming character and coating quality were examined. Results are shown in Table 1.

Furthermore, the water-soluble polycarboxylates and nonionic surfactants combined at first with the degreasing solutions in each of the examples and comparative examples were the same as those in the example 1. The "Plurafac (registered trademark) LF-700" is a trade name of an adduct of an aliphatic alcohol with polyethylene oxide polypropylene oxide (the cloud point is less than 15° C.), made by BASF Co., Ltd., and "Lutensol (registered trademark) TO8" is a trade name of isotridecanol octaethoxylate (the cloud point is 61° C.), made by BASF Co., Ltd.

TABLE 1

| | | Example 1 | | Example 2 | | Example 3 | | Example 4 | | Comparative Example 1 | | Comparative Example 2 | |
|---|---|---|---|---|---|---|---|---|---|---|---|---|---|
| | | initial | in passage of time | initial | in passage of time | initial | in passage of time | initial | in passage of time | initial | in passage of time | initial | in passage of time |
| Control of degreasing solution | | | | | | | | | | | | | |
| concentration (g/l) | sodium metasilicate pentahydrate | 5 | 4 | 5 | 3.6 | 5 | 5.1 | 5 | 3.7 | 5 | 4 | 5 | 6.5 |
| | soda ash | 13.0 | — | 13.0 | — | 13.0 | — | 13.0 | — | 13.0 | — | 13.0 | — |

TABLE 1-continued

| | | Example 1 | | Example 2 | | Example 3 | | Example 4 | | Comparative Example 1 | | Comparative Example 2 | |
|---|---|---|---|---|---|---|---|---|---|---|---|---|---|
| | | initial | in passage of time | initial | in passage of time | initial | in passage of time | initial | in passage of time | initial | in passage of time | initial | in passage of time |
| | caustic soda | 0 | — | 0 | — | 0 | — | 0 | — | 0 | — | 0 | — |
| | sodium bicarbonate | 2 | — | 2 | — | 2 | — | 2 | — | 2 | — | 2 | — |
| | water-soluble polycarboxylate | 2 | 2 | 2 | 2.4 | 2 | 1.8 | 2 | 1.8 | 2 | 0 | 2 | 1.7 |
| | nonionic surfactant | 1 | 1 | 1 | 1.2 | 1 | 0.9 | 1 | 0.9 | 1 | 1.5 | 1 | 0.9 |
| pH | | 11.2 | 11.0 | 11.2 | 10.6 | 11.2 | 11.2 | 11.2 | 11.2 | 11.2 | 11.0 | 11.2 | 10.2 |
| Si concentration (ppm) | | 650 | 520 | 650 | 470 | 650 | 660 | 650 | 480 | 650 | 520 | 650 | 850 |
| free alkali extent (point) | | 15.0 | 15.0 | 15.0 | 15.1 | 15.0 | 15.0 | 15.0 | 15.2 | 15.0 | 15.1 | 15.0 | 15.2 |
| calculated value by (a) equation | left side | 2.81 | 2.72 | 2.81 | 2.67 | 2.81 | 2.82 | 2.81 | 2.68 | 2.81 | 2.72 | 2.81 | 2.93 |
| | right side | 2.94 | 2.88 | 2.94 | 2.75 | 2.94 | 3.42 | 2.94 | 3.42 | 2.94 | 2.68 | 2.94 | 2.62 |
| Result | | | | | | | | | | | | | |
| degreasing capability | | ◎ | ◎ | ◎ | ◎ | ◎ | ○ | ◎ | ◎ | ◎ | x | ◎ | x |
| foaming character | | ◎ | ◎ | ◎ | ◎ | ◎ | ◎ | ◎ | ○ | ◎ | ◎ | ◎ | ◎ |
| coating quality | | ◎ | ◎ | ◎ | ◎ | ◎ | ○ | ◎ | ◎ | ◎ | x | ◎ | x |

TABLE 2

| | | | Example 1 | Example 2 | Example 3 | Example 4 | Comparative Example 1 | Comparative Example 2 |
|---|---|---|---|---|---|---|---|---|
| Supplementary chemicals | formulation of A agent (%) | sodium metasilicate pentahydrate | 20.0 | 15.0 | 30.0 | 20.0 | 20.0 | 30.0 |
| | | caustic soda | 30.0 | 25.0 | 40.0 | 40.0 | 30.0 | 5.0 |
| | | soda ash | 50.0 | 60.0 | 30.0 | 40.0 | 50.0 | 40.0 |
| | | sodium bicarbonate | — | — | — | — | — | 25.0 |
| | | Si content percent | 2.6 | 2.6 | 3.9 | 3.9 | 2.6 | 3.9 |
| | | NaOH content percent | 30.0 | 20.0 | 40.0 | 25.0 | 30.0 | 5.0 |
| | formulation of B agent (%) | Sokalan CP-5 | 20.0 | — | — | — | — | 20.0 |
| | | Sokalan PA-40 | — | 20.0 | — | — | — | — |
| | | Adekacol W-304 | — | — | 30.0 | — | — | — |
| | | Adekacol W-370 | — | — | — | 30.0 | — | — |
| | | Plurafac LF-220 | 10.0 | — | — | — | 30.0 | 10.0 |
| | | Plurafac LF-400 | — | 10.0 | — | — | — | — |
| | | Plurafac LF-700 | — | — | 20.0 | — | — | — |
| | | Lutensol T08 | — | — | — | 20.0 | — | — |
| | | Water | 70.0 | 70.0 | 50.0 | 50.0 | 70.0 | 70.0 |

As seen in Table 1, the results from examples show excellent degreasing capability, a small foaming character and excellent coating quality. In the examples, these three properties are especially superior in the case of using a nonionic surfactant such as an adduct of an aliphatic alcohol with an alkylene oxide, which contains ethylene oxide in 50 mole % or more of the alkylene oxide and contains either one or both of propylene oxide and butylene oxide in less than 50 mole %, and which has a cloud point in a range of from 25° to 50° C. (Examples 1 and 2 ). In contrast, since a water-soluble polycarboxylate is not used in the comparative example 1, the degreasing capability and the coating quality deteriorated with the passage of time. Also, in the comparative example 2, since pH of the degreasing solution is less than 10.5 and not satisfactory for the equation (a), the degreasing capability and the coating quality deteriorated with the passage of time.

What is claimed are:

1. A method of degreasing a metal selected from the group consisting of iron, zinc and aluminum comprising the steps of:

(i) bringing a phosphate-free degreasing solution in contact with said metal to be processed, wherein said degreasing solution contains an alkali silicate, a water-soluble polycarboxylate and a nonionic surfactant and initially satisfies conditions ①–⑤ as follows:

① The pH value of the degreasing solution is in a range of from 10.5 to 12.5;

② The concentration of an alkali silicate is 100 ppm or more calculated as Si concentration and satisfactory for the following (a) equation:

$$\log_{10}Y \leqq 0.318X+2.72 \quad \text{(a)}$$

wherein Y denotes the concentration of an alkali silicate calculated as Si concentration by a ppm unit, X=pH−10.5, and this pH denotes the pH value of the degreasing solution;

③ The concentration of a water-soluble polycarboxylate is in a range of from 0.01 to 10 g/liter;

④ The concentration of a nonionic surfactant is in a range of from 0.01 to 10 g/liter; and ⑤ The free alkali extent of said degreasing solution is in a range of from 5 to 25 points, wherein said free alkali extent is denoted in points by an amount (ml) of a 0.1N hydrochloric acid (or sulfuric acid) required to neutralize 10 ml of the degreasing solution, using phenolphthalein as an indicator;

(ii) controlling said degreasing solution by adding an agent A and an agent B whereby further amounts of at least said alkali silicate, said water-soluble polycarboxylate and said nonionic surfactant are added to said degreasing solution so as to satisfy and maintain conditions ①–⑤;

said agent A contains 1 to 6% by weight of said alkali silicate (calculated as Si concentration against the total alkali compounds), 20 to 60% by weight of an alkali carbonate, selected from the group consisting of sodium hydrogen carbonate, sodium carbonate, potassium hydrogen carbonate and potassium carbonate (against the total alkali compounds), and 10 to 50% by weight of a caustic alkali selected from the group consisting of sodium hydroxide and potassium hydroxide, (against the total alkali compounds), against a total 100% by weight of the three ingredients, and said agent B contains 5 to 40% by weight of said water-soluble polycarboxylate, 10 to 60% by weight of said nonionic surfactant and, 0 to 85% by weight of water against a total 100% by weight of these three ingredients.

2. The method of degreasing in accordance with claim 1, wherein the nonionic surfactant is an adduct compound of an aliphatic alcohol with an alkylene oxide containing ethylene oxide in 50 mole % or more of the alkylene oxide and containing either one or both of propylene oxide and butylene oxide in less than 50 mole %, and said adduct compound having a cloud point in a range of from 25° to 50° C.

3. A method of degreasing a metal selected from the group consisting of iron, zinc and aluminum comprising the steps of:

(i) preparing a phosphate-free degreasing solution containing an alkali silicate, a water-soluble polycarboxylate and a nonionic surfactant, which satisfies conditions (1)–(5) as follows:

(1) The pH value of the degreasing solution is in a range of from 10.5 to 12.5;

(2) The concentration of an alkali silicate is 100 ppm or more calculated as Si concentration and satisfactory for the following (a) equation:

$$\log_{10}Y \leqq 0.318X + 2.72 \quad \text{(a)}$$

wherein Y denotes the concentration of an alkali silicate calculated as Si concentration by a ppm unit, $X = pH - 10.5$, and this pH denotes the pH value of the degreasing solution;

(3) The concentration of a water-soluble polycarboxylate is in a range of from 0.01 to 10 g/liter;

(4) The concentration of a nonionic surfactant is in a range of from 0.01 to 10 g/liter; and (5) The free alkali extent of said degreasing solution is in a range of from 5 to 25, wherein said free alkali extent is denoted in points by an amount (ml) of a 0.1N hydrochloric acid (or sulfuric acid) required to neutralize 10 ml of the degreasing solution, using phenolphthalein as an indicator, (ii) bringing said phosphate-free degreasing solution in contact with the metal to be degreased; and (iii) subsequently adding an agent comprising a caustic alkali to said phosphate-free degreasing solution so as to maintain conditions (1)–(5), wherein said caustic alkali is selected from the group consisting of sodium hydroxide and potassium hydroxide; and said agent comprises an agent A containing 1 to 6% by weight of said alkali silicate (calculated as Si concentration against the total alkali compounds), 20 to 60% by weight of an alkali carbonate selected from the group consisting of sodium hydrogen carbonate, sodium carbonate, potassium hydrogen carbonate and potassium carbonate (against the total alkali compounds), and 10 to 50% by weight of said caustic alkali (against the total alkali compounds), against a total 100% by weight of the three ingredients, and an agent B containing 5 to 40% by weight of said water-soluble polycarboxylate, 10 to 60% by weight of said nonionic surfactant and, 0 to 85% by weight of water against a total 100% by weight of these three ingredients.

4. The method of degreasing in accordance with claim 3, wherein in step (i) said degreasing solution is free of caustic alkali.

5. The method of degreasing in accordance with claim 4, wherein said nonionic surfactant is an adduct compound of an aliphatic alcohol with an alkylene oxide containing ethylene oxide in about 50 mole % or more of the alkylene oxide and containing either one or both of propylene oxide and butylene oxide in less than about 50 mole %, and said adduct compound having a cloud point from about 25 to 50 degrees centigrade.

6. The method of degreasing in accordance with claim 3, wherein said nonionic surfactant is an adduct compound of an aliphatic alcohol with an alkylene oxide containing ethylene oxide in about 50 mole % or more of the alkylene oxide and containing either one or both of propylene oxide and butylene oxide in less than about 50 mole %, and said adduct compound having a cloud point of from about 25 to 50 degrees centigrade.

* * * * *